US009688450B2

(12) United States Patent
Hahn et al.

(10) Patent No.: US 9,688,450 B2
(45) **Date of Patent: *Jun. 27, 2017**

(54) GIFT CARD PACKAGING AND ASSOCIATED METHODS

(71) Applicant: Berwick Offray LLC, Berwick, PA (US)

(72) Inventors: Gregory Cameron Hahn, Orem, UT (US); Brian Chester Boxx, Provo, UT (US); Jennifer Lynn Garry, Pleasant Grove, UT (US)

(73) Assignee: Berwick Offray LLC, Berwick, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/168,736

(22) Filed: May 31, 2016

(65) Prior Publication Data

US 2016/0272401 A1 Sep. 22, 2016

Related U.S. Application Data

(63) Continuation of application No. 13/632,833, filed on Oct. 1, 2012, now Pat. No. 9,415,916.

(51) Int. Cl.

| | |
|---|---|
| ***B65D 77/26*** | (2006.01) |
| ***B65D 73/00*** | (2006.01) |
| ***B65D 75/28*** | (2006.01) |
| ***B65D 25/02*** | (2006.01) |
| ***B65D 81/127*** | (2006.01) |
| ***B42D 25/20*** | (2014.01) |
| ***B65D 77/20*** | (2006.01) |

(52) U.S. Cl.

CPC ..... *B65D 77/26* (2013.01); *B42D 25/285* (2014.10); *B65D 25/02* (2013.01); *B65D 73/00* (2013.01); *B65D 75/28* (2013.01); *B65D 77/20* (2013.01); *B65D 81/127* (2013.01)

(58) Field of Classification Search

CPC ..... B65D 77/26; B65D 77/20; B42D 25/285
USPC ..... 206/307, 523, 521, 521.6; 70/63
See application file for complete search history.

(56) References Cited

U.S. PATENT DOCUMENTS

| | | | |
|---|---|---|---|
| 1,639,750 | A | 8/1927 | Portman |
| D126,123 | S | 3/1941 | Clemens |
| 3,905,543 | A | 9/1975 | Randles |
| 4,240,240 | A | 12/1980 | Cohen |
| D271,283 | S | 11/1983 | Taylor |
| D295,962 | S | 5/1988 | Conlon |
| D340,761 | S | 10/1993 | Long |
| D365,482 | S | 12/1995 | Larimore |
| D369,469 | S | 5/1996 | Gregory |
| D372,670 | S | 8/1996 | Healey |
| D417,391 | S | 12/1999 | Szczepanski et al. |
| D444,058 | S | 6/2001 | Hampshire et al. |
| D447,687 | S | 9/2001 | Roby |
| D459,078 | S | 6/2002 | Tondino |
| D466,725 | S | 12/2002 | Masciale |
| D572,588 | S | 7/2008 | Osborn et al. |
| D576,873 | S | 9/2008 | Kim |
| 7,419,055 | B2 | 9/2008 | Manuel |
| D579,514 | S | 10/2008 | Kelps |
| D584,959 | S | 1/2009 | Tinsley |
| D628,386 | S | 12/2010 | Kohn |
| D630,704 | S | 1/2011 | Kochanski |
| 7,905,388 | B2 | 3/2011 | Bowman |
| 7,946,424 | B2 | 5/2011 | Gupta |
| D653,088 | S | 1/2012 | Hansen et al. |
| 8,091,779 | B2 | 1/2012 | Holt et al. |
| 8,109,389 | B1 | 2/2012 | Amer |
| D663,205 | S | 7/2012 | Nelson et al. |
| D663,206 | S | 7/2012 | Nelson et al. |
| D663,207 | S | 7/2012 | Nelson et al. |
| 2001/0020595 | A1 | 9/2001 | Koike |
| 2001/0030141 | A1 | 10/2001 | Kasakura |
| 2005/0173288 | A1 | 8/2005 | Chiang |
| 2006/0151349 | A1 | 7/2006 | Andrews et al. |
| 2009/0114707 | A1 | 5/2009 | Navarre |
| 2010/0224516 | A1 | 9/2010 | Abell |

OTHER PUBLICATIONS

Design shown in drawings of U.S. Appl. No. 29/436,432, filed Nov. 6, 2012 (Date: Applicant Admitted Prior Art) (7 sheets).
U.S. Appl. No. 29/436,432, filed Nov. 6, 2012 (9 pages).
Notice of Allowance mailed Mar. 22, 2013 for U.S. Appl. No. 29/436,432, filed Nov. 6, 2012 (9 pages).
Notice of Abandonment dated Dec. 9, 2013, from U.S. Appl. No. 29/436,432 (1 page).
Notice of Allowance dated Aug. 23, 2013, from U.S. Appl. No. 29/436,432 (7 pages).
Office Action mailed Jan. 4, 2013, from U.S. Appl. No. 13/632,833 (7 pages).
Amendment dated July, 3, 2013, from U.S. Appl. No. 13/632,833 (9 pages).
Office Action mailed Oct. 23, 2013, from U.S. Appl. No. 13/632,833 (7 pages).
Amendment dated Apr. 17, 2014, from U.S. Appl. No. 13/632,833 (9 pages).
Office Action mailed May 16, 2014, from U.S. Appl. No. 13/632,833 (7 pages).

(Continued)

*Primary Examiner* — Anthony Stashick
*Assistant Examiner* — Raven Collins
(74) *Attorney, Agent, or Firm* — McCarter & English, LLP

(57) ABSTRACT

Exemplary embodiments of a gift card box and associated methods are provided, generally including a base section including a first insert configured and dimensioned to receive a gift card. The exemplary gift card box generally includes a lid section including a second insert configured and dimensioned to cooperatively mate with the first insert. The first insert and the second insert substantially fix the gift card inside the gift card box when cooperatively mated. An exemplary method of assembling a gift card box is provided, generally including providing a base section, providing a lid section, and substantially fixing the gift card inside the gift card box by cooperatively mating the first insert and the second insert. The base section generally includes a window configured and dimensioned to permit visualization of indicia on the gift card.

12 Claims, 12 Drawing Sheets

(56) References Cited

OTHER PUBLICATIONS

Amendment dated Nov. 17, 2014, from U.S. Appl. No. 13/632,833 (11 pages).
Office Action mailed Feb. 23, 2015, from U.S. Appl. No. 13/632,833 (7 pages).
Reply dated Aug. 21, 2015, from U.S. Appl. No. 13/632,833 (11 pages).
Office Action mailed Jan. 4, 2016, from U.S. Appl. No. 13/632,833 (8 pages).
Amendment dated Apr. 4, 2016, from U.S. Appl. No. 13/632,833 (7 pages).
Notice of Allowance mailed Apr. 27, 2016 for U.S. Appl. No. 13/632,833, filed Oct. 1, 2012 (4 pages).

GIFT CARD PACKAGING AND ASSOCIATED METHODS

CROSS-REFERENCE TO RELATED APPLICATION

The present application is a continuation application of, and claims the benefit of priority to, U.S. patent application Ser. No. 13/632,833 filed Oct. 1, 2012, the disclosure of which is incorporated herein by reference in its entirety for all purposes.

TECHNICAL FIELD

The present disclosure relates to gift card packaging and, in particular, to a gift card box including inserts for fixing a gift card.

BACKGROUND

Gift cards are commonly sold by retailers as a means for providing a gift of a predetermined monetary value to others without selecting a particular item. For example, gift cards may be provided by specific stores, credit card companies, and/or the like. Retailers generally provide gift cards as an unpackaged and individually presented item, packaged in a gift card box and/or envelope, and/or the like.

Gift card packaging can generally be provided in different forms and may include means for supporting the gift card. In addition, gift card packaging generally fully houses the gift card such that the gift card needs to be removed from the packaging for provisioning and/or activation.

Thus, a need exists for gift card packaging which provides support to maintain a desired orientation of a gift card during transport and/or manipulation and gift card packaging which allows a gift card to be provisioned and/or activated without having to remove the gift card from the packaging. These and other needs are addressed by the gift card packaging and associated methods of the present disclosure.

SUMMARY

In accordance with embodiments of the present disclosure, an exemplary gift card box is provided, generally including a base section including a first insert configured and dimensioned to receive a gift card. The exemplary gift card generally includes a lid section including a second insert configured and dimensioned to cooperatively mate with the first insert. The first insert and the second insert substantially fix the gift card inside the gift card box when cooperatively mated.

The first insert and the second insert can be fabricated from, for example, a foam material, a flexible material, and/or the like. The base section can include a window configured and dimensioned to permit visualization of indicia, such as a bar code, a price indicator, instructions, graphics, logos, and/or the like, on the gift card. The lid section and the base section can be configured and dimensioned to cooperatively mate. Cooperatively mating the lid section and the base section generally cooperatively mates the first insert and the second insert.

The exemplary gift card box generally includes complementary alignment features defined by the first insert and the second insert for aligning the first insert relative to the second insert. The complementary alignment features generally align the lid section relative to the base section. The exemplary gift card box generally includes at least one decoration, such as a bow and/or the like, including an inner passage configured and dimensioned to slidably receive a cooperatively mated lid section and base section.

In accordance with embodiments of the present disclosure, an exemplary method of assembling a gift card box is provided, generally including providing a base section including a first insert configured and dimensioned to receive a gift card. The exemplary method generally includes providing a lid section including a second insert configured and dimensioned to cooperatively mate with the first insert. In general, the exemplary method further includes substantially fixing the gift card inside the gift card box within the first insert of the base section.

The exemplary method generally includes inserting the gift card within the first insert of the base section. The exemplary method generally includes cooperatively mating the lid section and the base section to cooperatively mate the first insert and the second insert. In general, the exemplary method includes aligning complementary alignment features defined by the first insert and the second insert. The exemplary method generally includes slidably receiving a cooperatively mated lid section and base section within an inner passage of at least one decoration.

Other objects and features will become apparent from the following detailed description considered in conjunction with the accompanying drawings. It is to be understood, however, that the drawings are designed as an illustration only and not as a definition of the limits of the invention.

BRIEF DESCRIPTION OF THE DRAWINGS

To assist those of skill in the art in making and using the disclosed gift card packaging and associated methods, reference is made to the accompanying figures, wherein.

DESCRIPTION OF EXEMPLARY EMBODIMENTS

It should be understood that the relative terminology used herein, such as "front", "rear", "left", "top", "bottom", "vertical", and "horizontal" is solely for the purposes of clarity and designation and is not intended to limit the invention to embodiments having a particular position and/or orientation. Accordingly, such relative terminology should not be construed to limit the scope of the present invention. In addition, it should be understood that the invention is not limited to embodiments having specific dimensions. Thus, any dimensions provided herein are merely for an exemplary purpose and are not intended to limit the invention to embodiments having particular dimensions.

Figure 1:
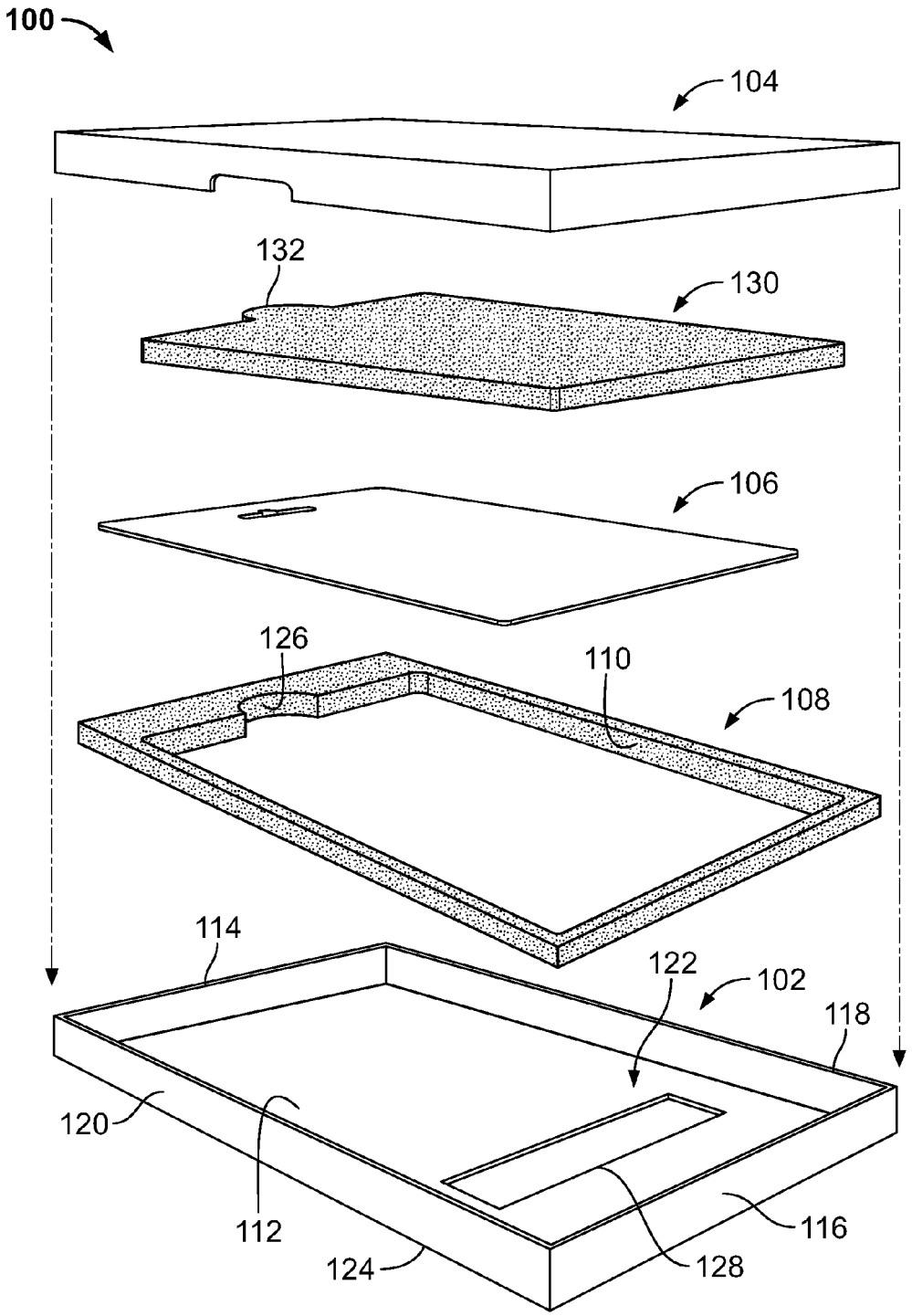
FIG. 1 shows a top perspective, unassembled view of an exemplary gift card box assembly.

Turning to FIG. 1, a top perspective, unassembled view of an exemplary gift card packaging (e.g., a gift card box) assembly 100 (hereinafter "assembly 100") is provided. In particular, the exemplary assembly 100 generally includes a base 102 and a lid 104 configured and dimensioned to house a gift card 106. As will be discussed in greater detail below, the base 102 and the lid 104 generally include inserts, e.g., foam inserts, configured and dimensioned to cooperatively mate relative to each other. The inserts can be fabricated from, for example, a die cut EVA foam card, and/or the like.

As can be seen in FIG. 1, base 102 generally defines a bottom wall 112, a front wall 114, a rear wall 116, a right wall 118 and a left wall 120. The front wall 114 and the rear wall 116 can be substantially parallel. Similarly, the right wall 118 and the left wall 120 can be substantially parallel. The base 102 further defines an inside surface 122 and an outside surface 124. In some exemplary embodiments, the outer periphery of the base 102 can be configured as, for example, substantially rectangular, square, circular, oval, and/or the like.

Base 102 generally includes a base insert 108, such as a first insert, configured and dimensioned to fit within the inner periphery of the base 102. The base insert 108 generally defines a female alignment member 126 for forming an interference fit. A lid insert 130, such as a second insert, can generally be located within an inner periphery of the lid 104 and defines a complementary male alignment member 132 for forming an interference fit. In some exemplary embodiments, inserts of the base 102 and the lid 104 may be fabricated without male and/or female alignment members. Although illustrated as a half circle alignment member for forming an interference fit, in some exemplary embodiments, the alignment member can be configured as, for example a square, a rectangle, an oval, a triangle, and/or the like. In some exemplary embodiments, the base insert 108 can be secured to the base 102 by, for example, a friction fit, an adhesive, and/or the like. The base insert 108 can be configured and dimensioned to receive a gift card 106 within an inner periphery 110 of the base insert 108. As would be understood by those of ordinary skill in the art, the inner periphery 110 can be dimensioned such that the gift card 106 is prevented from translation along a horizontal plane. In addition, the inner periphery 110 generally defines a ledge for maintaining the gift card 106 within the base 102.

In some exemplary embodiments, the gift card 106 can include, for example, an open loop card, card packaging, indicia 146, and/or the like, such as a bar code that can be scanned at a point of sale. The base 102 generally includes a window 128, such as an aperture, configured and dimensioned to permit visualization of indicia 146 on the gift card 106. In particular, the configuration of the gift card 106 as it is positioned in the inner periphery 110 of the base insert 108 can be such that the desired indicia 146 of the gift card 106 is located over the window 128. Thus, when viewing the base 102 from the outside surface 124, the indicia 146 of the gift card 106 can generally be visualized through the window 128 and is positioned for scanning (and gift card 106 provisioning and/or activation) at a point of sale without having to open the assembly 100.

Figure 2:
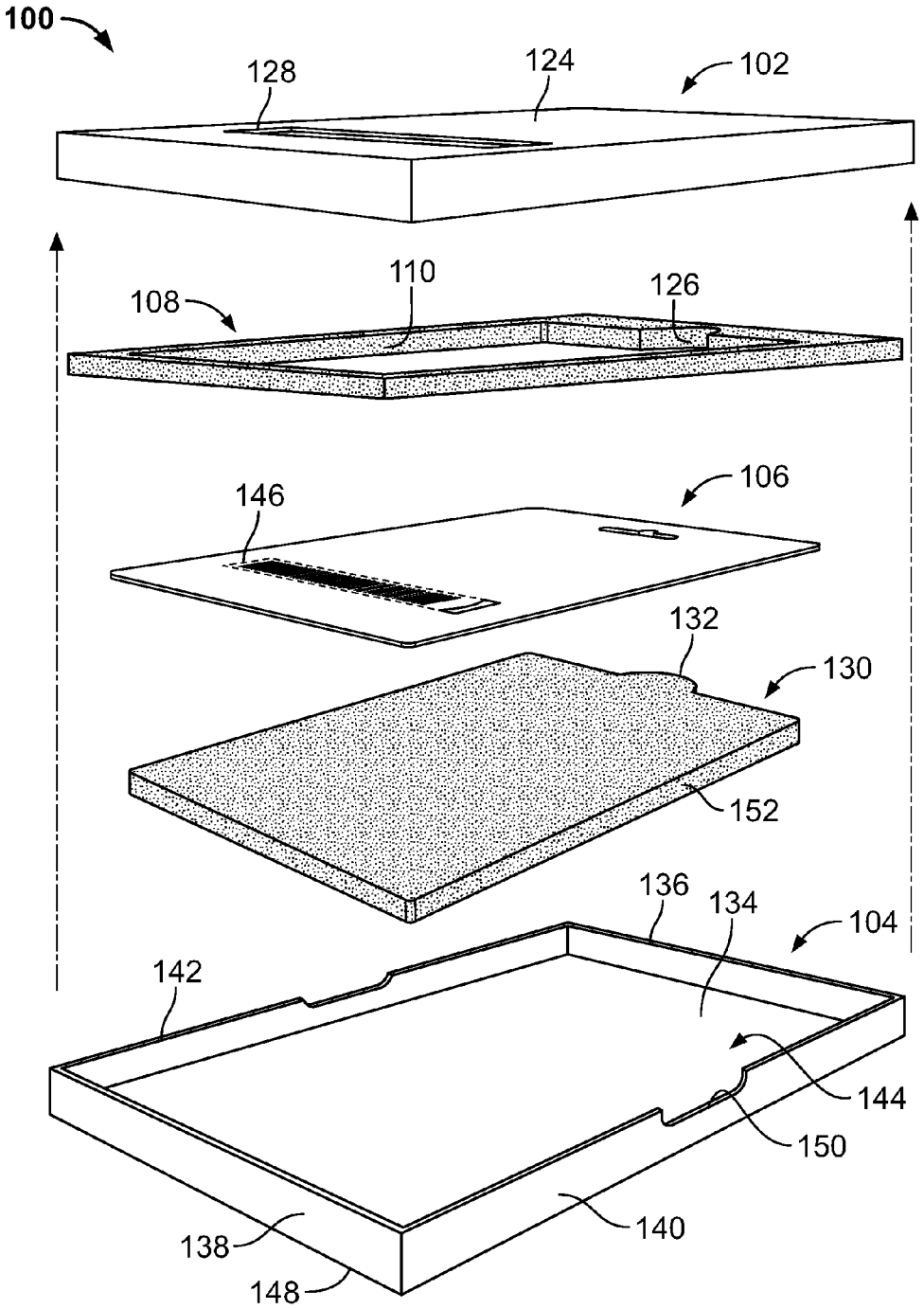
FIG. 2 shows a bottom perspective, unassembled view of an exemplary gift card box assembly.

With reference to FIG. 2, a bottom perspective, unassembled view of the exemplary assembly 100 is provided. The exemplary assembly 100 generally includes a base 104, a lid 102 and a gift card 106. As discussed above, the gift card 106 generally includes indicia 146, such as instructions, a scannable bar code, a price, information, and/or the like, provided thereon. As can be seen in FIG. 2, the indicia 146 on the gift card 106 can be oriented such that it is visible through the window 128 of the base 102. Thus, for example, a user can scan the bar code on the gift card 106 through the window 128 without having to open the assembly 100.

The lid 104 generally includes a bottom wall 134, a front wall 136, a rear wall 138, a right wall 140 and a left wall 142. The front wall 136 and the rear wall 138 can be substantially parallel relative to each other. Similarly, the right wall 140 and the left wall 142 can be substantially parallel relative to each other. The lid 104 generally includes an inside surface 144 and an outside surface 148. In some exemplary embodiments, the lid 104 can include, for example, cutouts 150, tabs, surface features, and/or the like, to aid the user in grasping and/or removing the lid 104 for opening and/or closing the assembly 100.

As discussed above, the lid 104 generally includes a lid insert 130, such as a second insert, which defines a male alignment member 132 for forming an interference fit. In some exemplary embodiments, the lid insert 130 can be fixed to the lid 104 with, for example, adhesives, and/or the like. The lid insert 130 defines an outer periphery 152 which can be configured and dimensioned to cooperatively mate with the inner periphery 110 of the base insert 108. The lid insert 130 and the base insert 108 can be fabricated from a single piece of material, such as foam, and/or the like. In particular, the lid insert 130 can be cut from the single piece of material such that the remaining material defines the base insert 108. In some exemplary embodiments, the lid insert 130 and the base insert 108 can be fabricated from different pieces of material.

As would be understood by those of ordinary skill in the art, once a gift card 106 has been inserted into the inner periphery 110 of the base insert 108, the lid 104 may be placed and/or pressed onto the base 102 such that the base insert 108 and the lid insert 130 cooperatively mate. In particular, the lid insert 130 generally prevents the gift card 106 from lifting away from the bottom wall 112 of the base 102. The male and female alignment members 132 and 126 can aid in maintaining the desired orientation of the lid 104 relative to the base 102 and form an interference fit. Thus, if the male and female alignment members 132 and 126 have not been properly aligned relative to each other, the male alignment member 132 can generally prevent the lid 104 from closing and/or lowering onto the base 102. Once the lid 104 has been removed from the base 102, the user may implement the female alignment member 126 as an opening/unobstructed area for gripping and/or removing the gift card 106 from the base 102.

Figure 3:
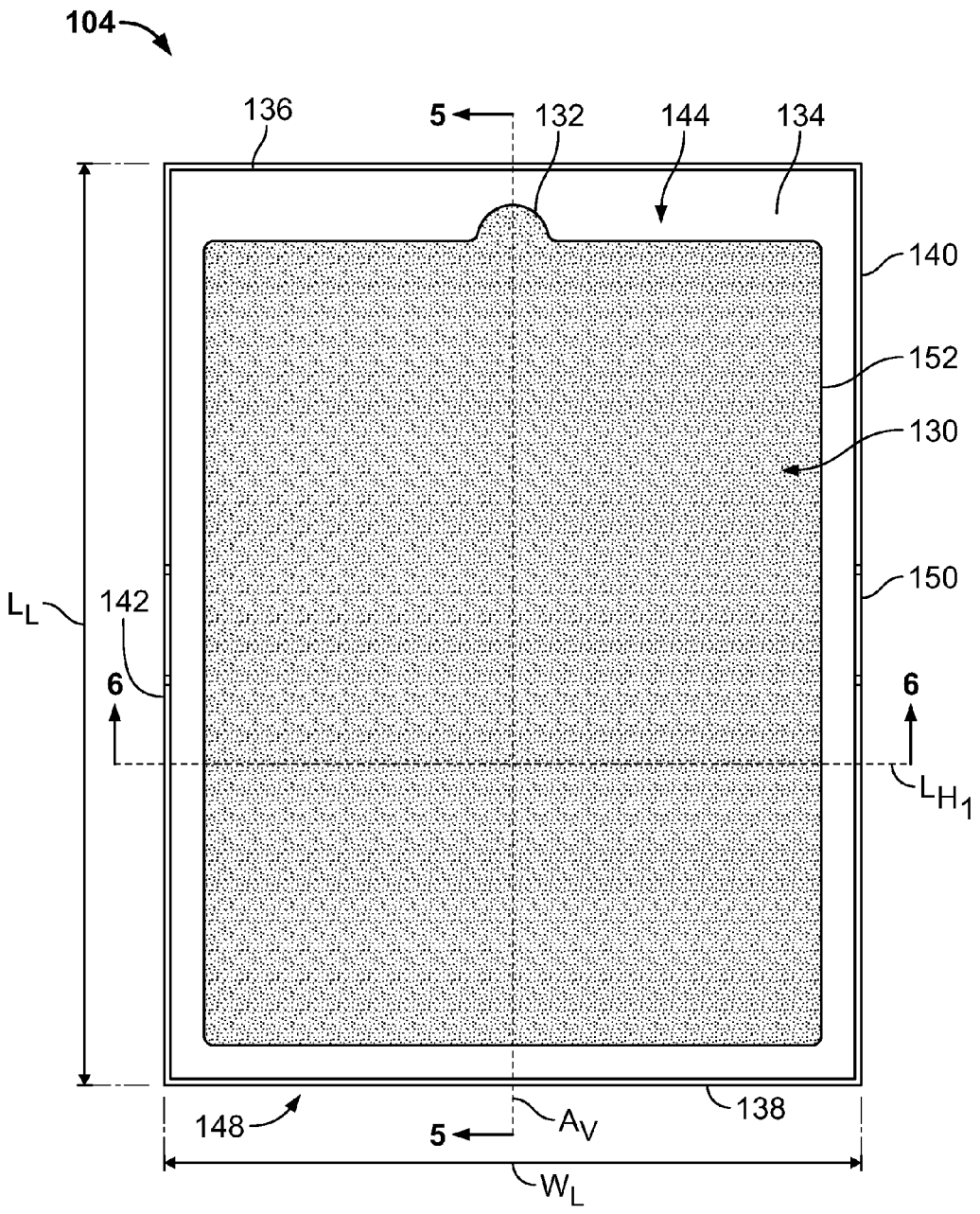
FIG. 3 shows a top view of an inside surface of an exemplary lid.
Figure 4:
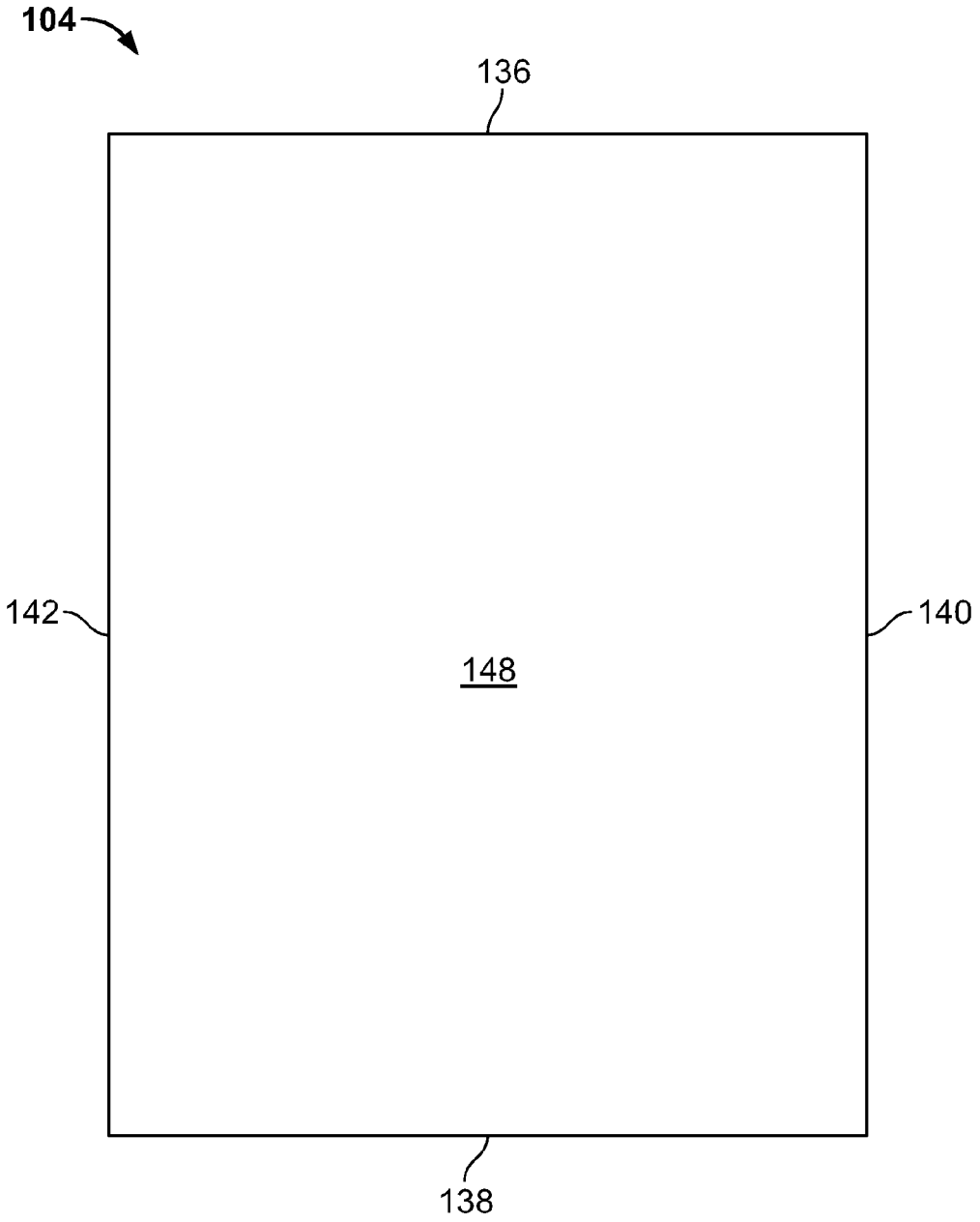
FIG. 4 shows a top view of an outside surface of an exemplary lid.

FIG. 3 shows a top view of the inside surface 144 of an exemplary lid 104, including the lid insert 130. The lid 104 and the lid insert 130 can be substantially symmetrical about a vertical axis $A_V$. The lid 104 is also provided with a horizontal section line $L_{H1}$, which will be discussed with respect to FIG. 6. An exemplary width $W_L$ of the lid 104 can be approximately 114 mm and an exemplary length $L_L$ of the lid 104 can be approximately 151.5 mm. FIG. 4 shows a top view of an outside surface 148 of an exemplary lid 104. The outside surface 148 of the lid 104 can include, for example, graphics, logos, information, and/or the like, provided thereon.

Figure 5:
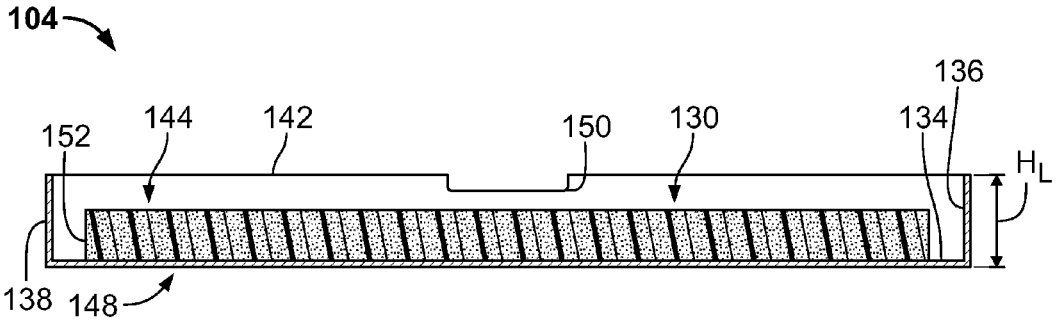
FIG. 5 shows a cross-sectional view of an exemplary lid along a vertical section line.
Figure 6:
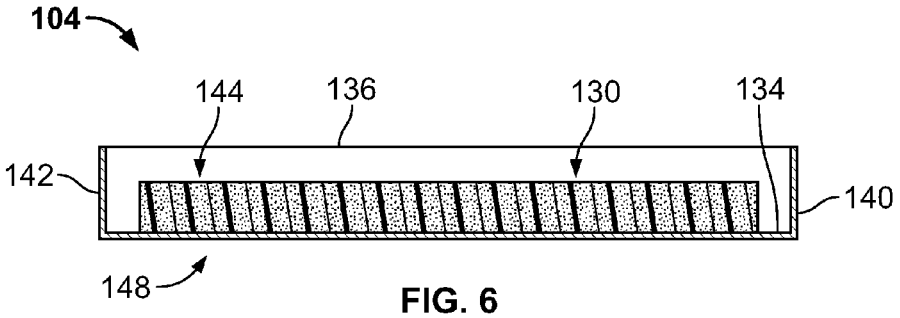
FIG. 6 shows a cross-sectional view of an exemplary lid along a horizontal section line.

With reference to FIG. 5, a cross-sectional view of an exemplary lid 104 along the vertical axis $A_V$ is provided. As described above, the lid insert 130 can be secured to the bottom wall 134 of the lid 104 with, for example, adhesives, and/or the like. An exemplary height $H_L$ of the lid 104 can be approximately 15 mm. FIG. 6 shows a cross-sectional view of an exemplary lid 104 along a horizontal section line $L_{H1}$. As can be seen from FIGS. 5 and 6, the space between the outer periphery 152 of the lid insert 130 and the inner periphery of the lid 104 can generally be configured and dimensioned to receive the base insert 108 such that the lid insert 130 and the base insert 108 cooperatively mate relative to each other with, for example, a friction fit, and/or the like.

Figure 7:
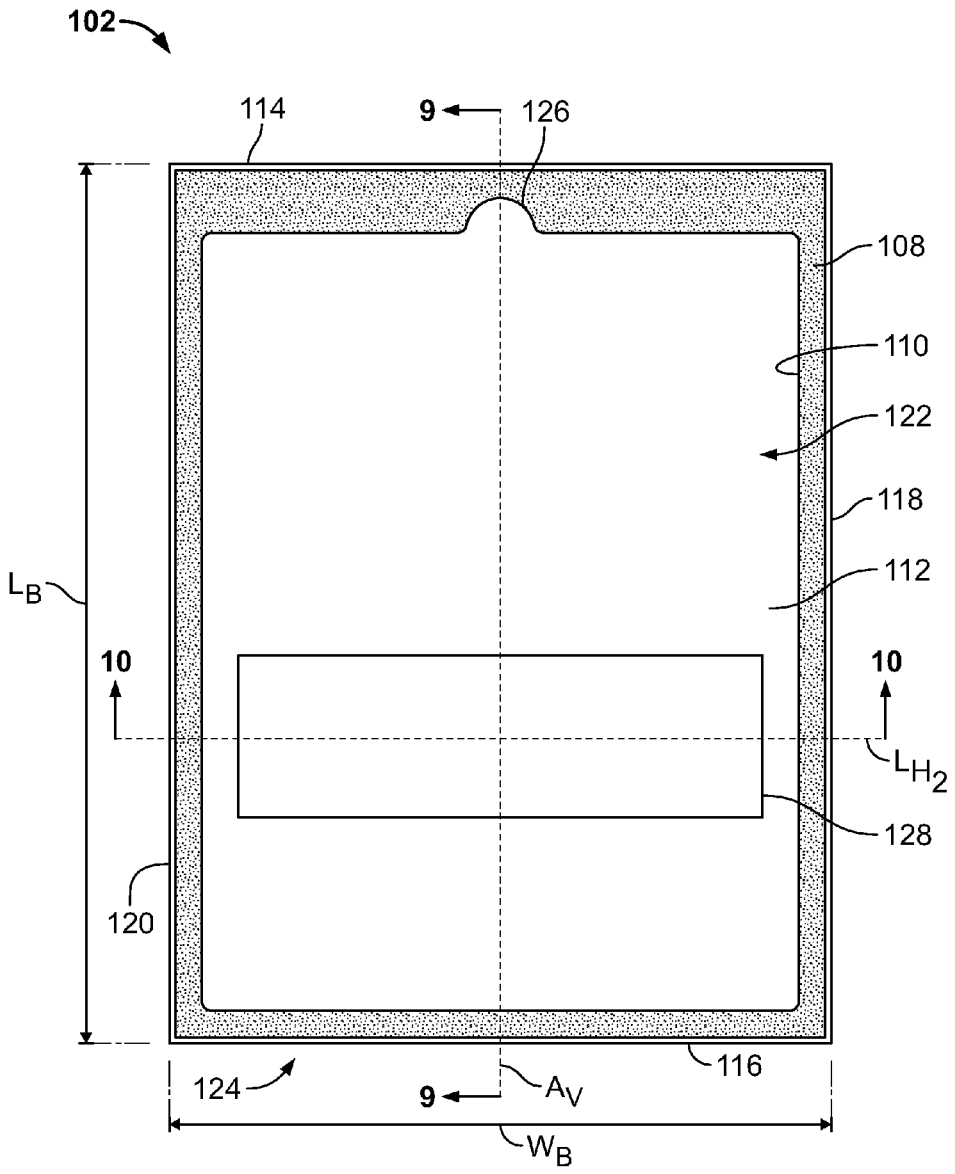
FIG. 7 shows a top view of an inside surface of an exemplary base.

Turning now to FIG. 7, a top view of an inside surface 122 of an exemplary base 102 is provided, including a base insert 108. The base 102 and the base insert 108 can be substantially symmetrical along the vertical axis $A_V$. As described above, the base insert 108 can be secured to the bottom wall 112 and/or the inner periphery of the side walls of the base 102 with, for example, a friction fit, adhesives, and/or the like. The exemplary base 102 generally defines a width $W_B$ and a length $L_B$. As would be understood by those of ordinary skill in the art, the width $W_B$ and length $L_B$ of the base 102 can generally be slightly smaller than the width $W_L$ and length $L_L$ of the lid 104. For example, the width $W_B$ of the base 102 can be approximately 112 mm and the length $L_B$ of the base 102 can be approximately 149.5 mm. The slightly greater dimensions of the lid 104 generally allow a user to place the lid 104 over the base 102 to close the assembly 100. In some exemplary embodiments, the difference in dimensions can further create a friction fit between the inner surfaces of the lid 104 and the outer surfaces of the base 102 to maintain the assembly 100 in a closed configuration.

Figure 8:
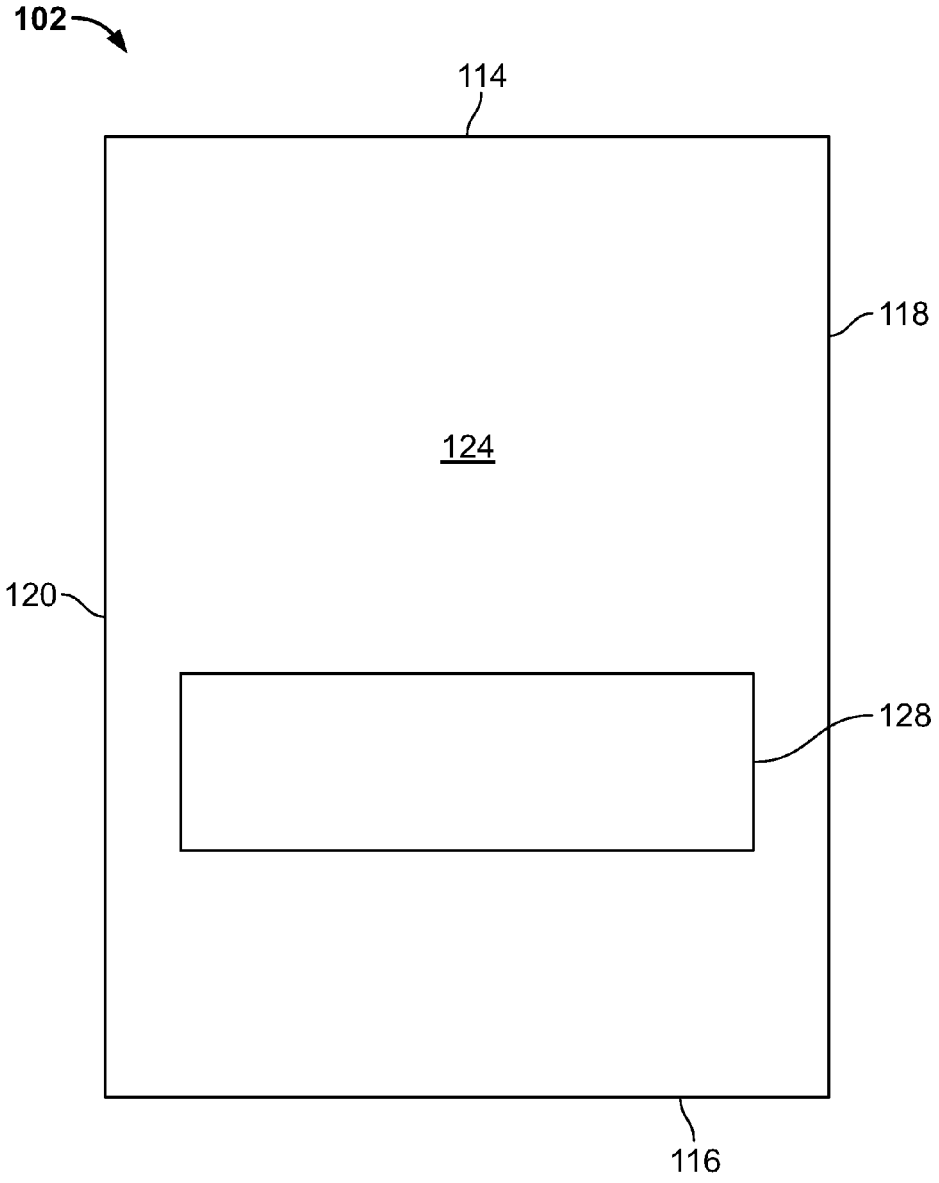
FIG. 8 shows a top view of an outside surface of an exemplary base.

FIG. 8 shows a top view of an outside surface 124 of an exemplary base 102. The outside surface 124 of the base 102 can include, for example, graphics, logos, information, and/or the like, provided thereon. As discussed above, when a gift card 106 is positioned inside the base 102, the indicia 146 on the gift card 106 can generally be visualized through the window 128. Thus, a user can, for example, scan a bar code on the gift card 106, provision the gift card, activate the gift card, and/or the like, at a point of sale without having to open the assembly 100.

Figure 9:
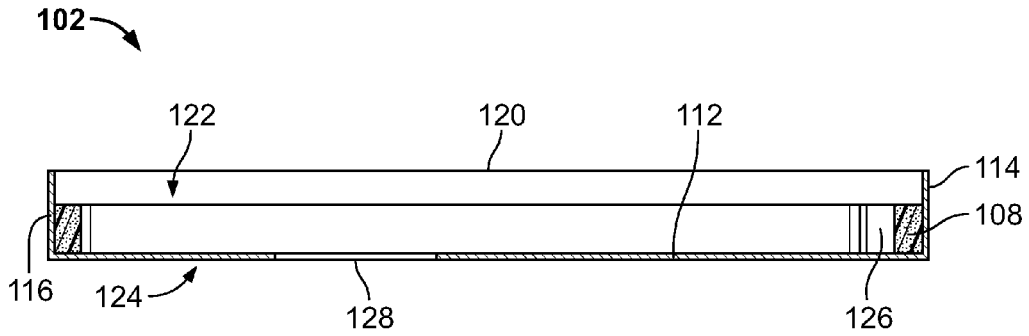
FIG. 9 shows a cross-sectional view of an exemplary base along a vertical section line.
Figure 10:
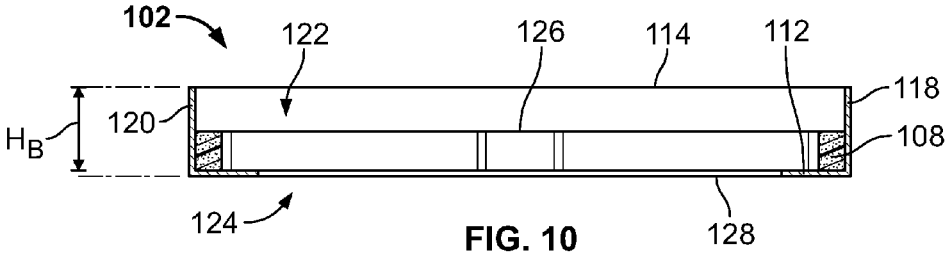
FIG. 10 shows a cross-sectional view of an exemplary base along a horizontal section line.

FIGS. 9 and 10 show cross-sectional views of an exemplary base 102 along the vertical axis $A_V$ and along a horizontal section line $L_{H2}$ aligned with the horizontal section line $L_{H1}$, respectively. As can be seen from FIGS. 9 and 10, the inner periphery 110 of the base insert 108 can generally be configured and dimensioned to receive a gift card 106 and/or a lid insert 130 such that the lid insert 130 and the base insert 108 cooperatively mate relative to each other with, for example, a friction fit, and/or the like. An exemplary height $H_B$ of the base 102 can be substantially similar to the height $H_L$ of the lid 104. In some exemplary embodiments, the height $H_B$ of the base 102 can be slightly smaller or greater than the height $H_L$ of the lid 104, for example, approximately 14 mm, 16 mm, and/or the like.

Figure 11:
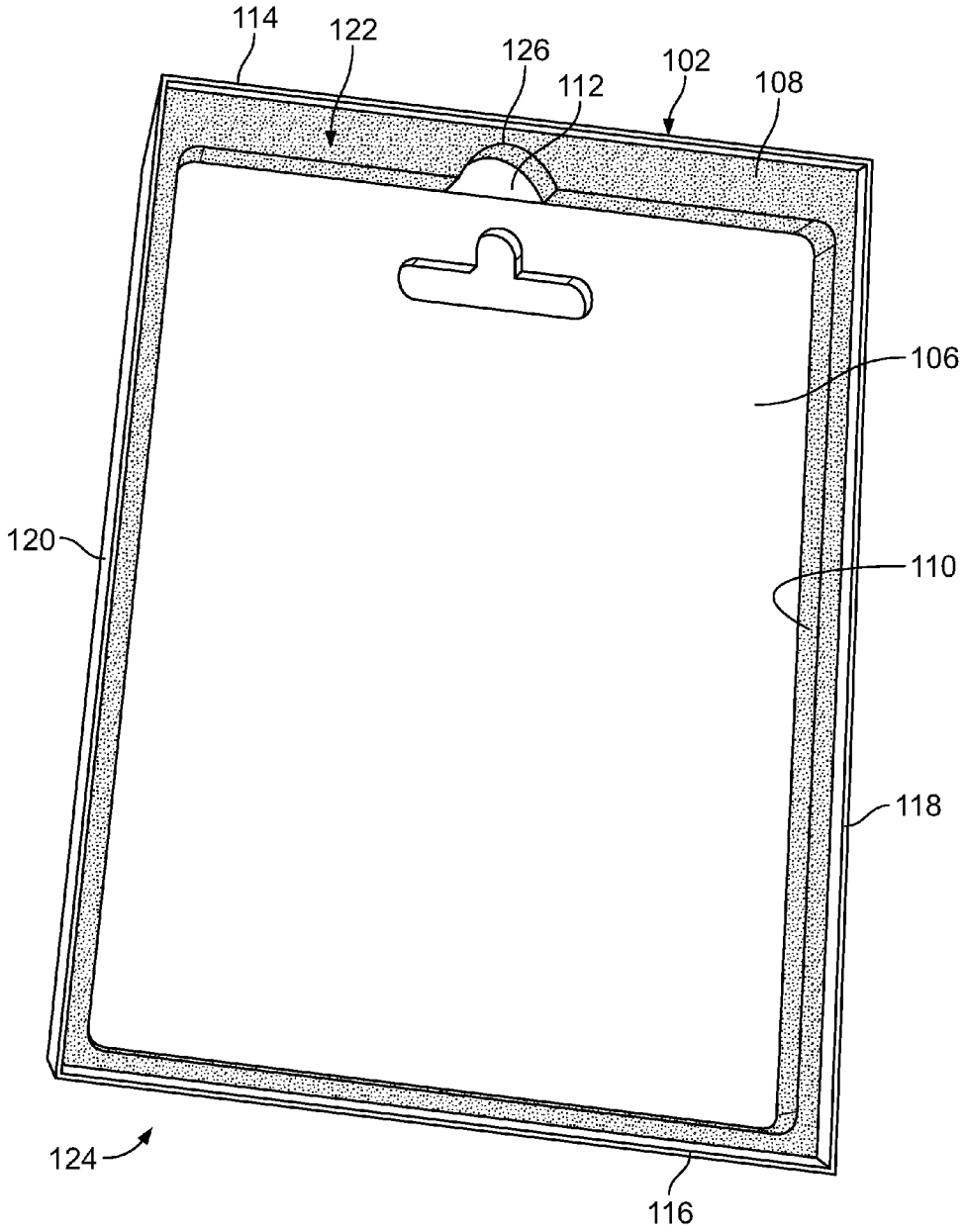
FIG. 11 shows a perspective view of an exemplary base with an exemplary gift card.

Turning now to FIG. 11, an exemplary base 102 with an exemplary gift card 106 is provided. In particular, FIG. 11 shows a gift card 106 which has been inserted into the inner periphery 110 of the base insert 108. The inner periphery 110 of the base insert 108 can be configured and dimensioned slightly greater than the gift card 106. Thus, the base insert 108 can receive the gift card 106 within the inner periphery 110 and the gift card 106 can be inserted and/or pushed to substantially mate against the bottom wall 112 of the base 102.

Figure 12:
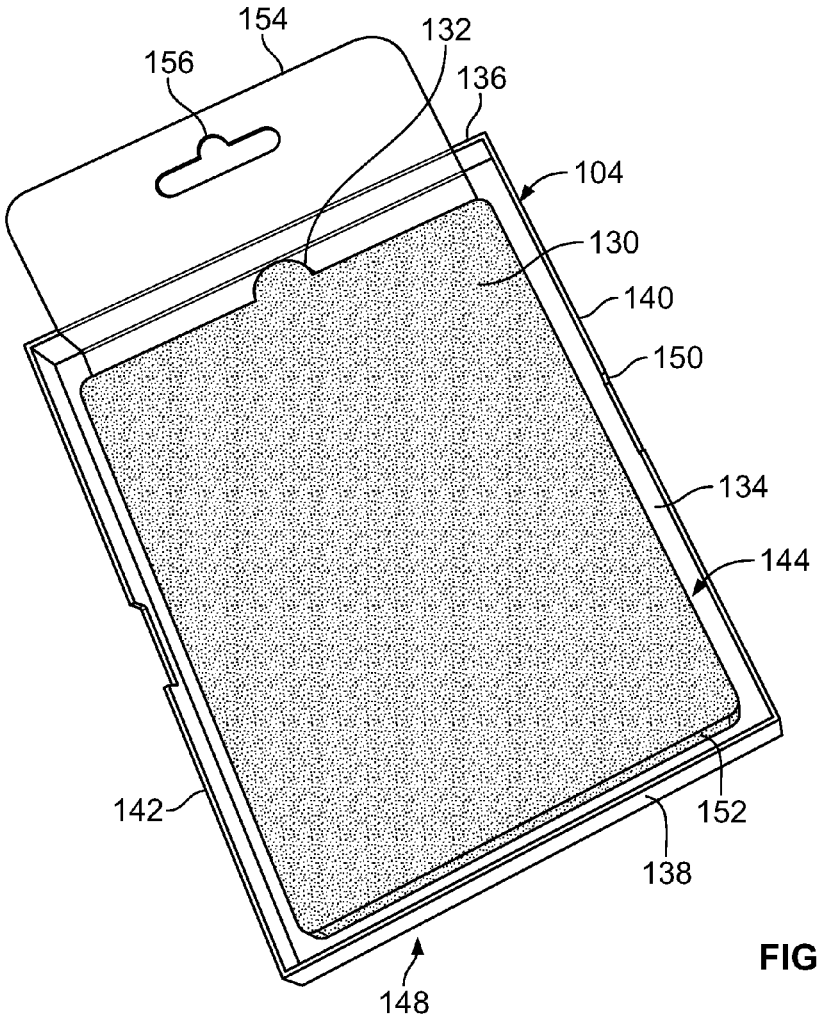
FIG. 12 shows a perspective view of an exemplary lid.

FIG. 12 shows an exemplary lid 104, including a lid insert 130. In some exemplary embodiments, the lid 104 can include a hang tab 154 for hanging the assembly 100 on a display peg (not shown). The hang tab 154 generally includes a hole 156 for hanging the assembly 100 on the display peg. Thus, the exemplary assembly 100 can be, for example, placed on a shelf, hung from a display peg, and/or the like. The hang tab 154 can be fabricated from, for example, plastic, cardboard, a durable material, and/or the like. In some exemplary embodiments, the hang tab 154 can be fabricated from a single piece of material and can be further folded to cooperatively mate against the inner portion of the front wall 136 and/or the bottom wall 134 of the lid 104. The hang tab 154 can further be secured to the lid 104 with, for example, adhesives, and/or the like.

Figure 13:
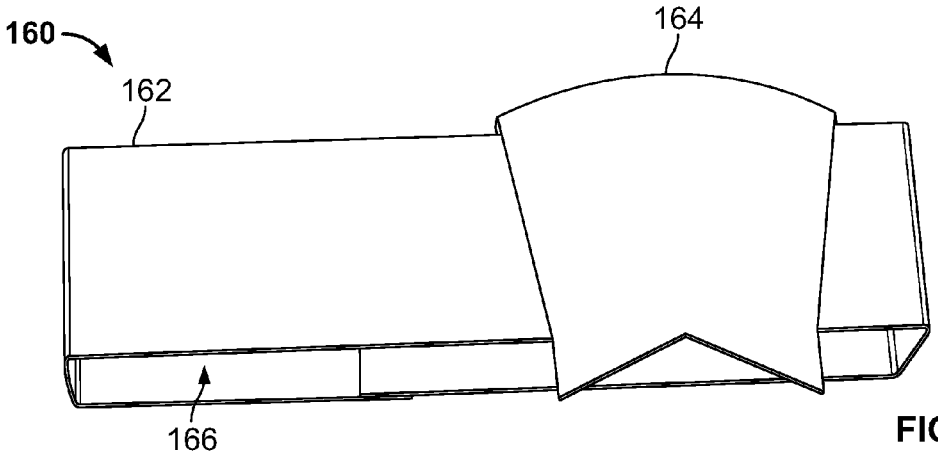
FIG. 13 shows a perspective view of an exemplary decoration.

With reference to FIG. 13, an exemplary decoration 160 is illustrated. The decoration 160 can be, for example, a bow, and/or the like, and generally includes a strip 162 and a bow 164. The strip 162 generally forms an inner passage 166 configured and dimensioned to slidably receive an assembled assembly 100. In some exemplary embodiments, the decoration 160 can be implemented to maintain the assembly 100 in an assembled manner such that the decoration 160 can prevent the opening of the lid 104 relative to the base 102. The decoration 160 can be fabricated from, for example, cardboard, fabric, and/or the like.

Figure 14:
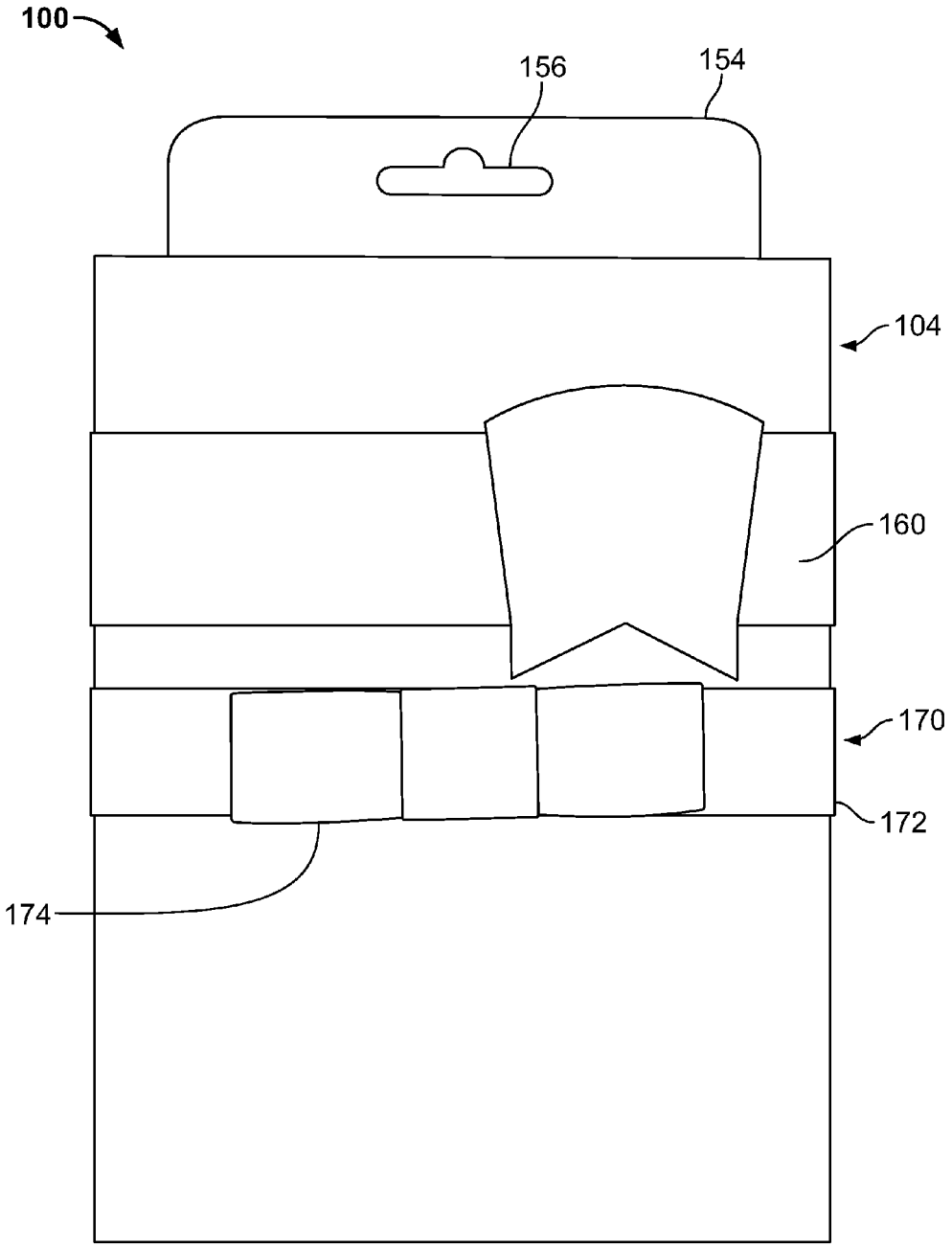
FIG. 14 shows a top perspective, assembled view of an exemplary gift card box assembly.

FIG. 14 shows a top perspective, assembled view of an exemplary assembly 100 for a gift card 106. In assembled form, as described above, the lid 104 and the base 102 have been cooperatively mated. In particular, the gift card 106 has been placed inside the base 102, the lid 104 has been placed over the base 102, the male and female alignment members 132 and 126 have been aligned, and the lid insert 130 and the base insert 108 have been cooperatively mated. In some exemplary embodiments, the assembly 100 may include a hang tag 154 which protrudes from within the lid 104 at the front wall 136 for hanging the assembly 100 on a display peg. A decoration 160 may be placed around the lid 104 and the base 102 to maintain the lid 104 and the base 102 in assembled form.

In some exemplary embodiments, a second decoration 170, for example, a bow, and/or the like, can be placed around the assembly 100. The second decoration 170 can be fabricated from, for example, cardboard, fabric, and/or the like. The second decoration 170 generally includes a strip 172 and a bow 174. When tied around and/or positioned over the assembly 100, the decoration 170 generally forms an inner passage configured and dimensioned to receive the assembled assembly 100. Although illustrated with both decorations 160 and 170, in some exemplary embodiments, the assembly 100 can include, for example, no decorations, one decoration, two decorations, and/or the like.

Figure 15:
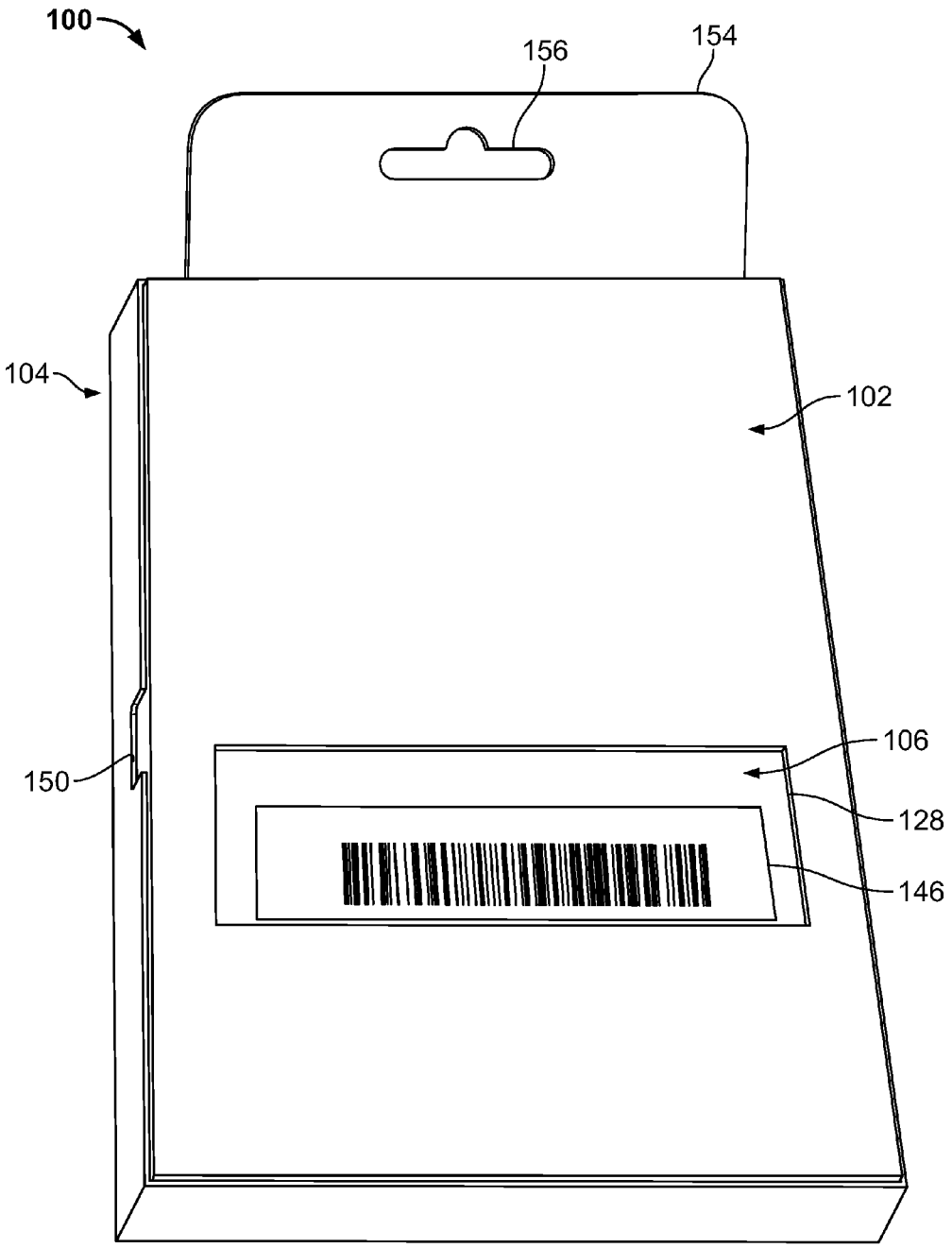
FIG. 15 shows a bottom perspective, assembled view of an exemplary gift card box assembly.

FIG. 15 shows a bottom perspective, assembled view of an exemplary assembly 100 for a gift card 106. In assembled form, the lid insert 130 generally provides pressure against the gift card 106 located in the base 102 such that the gift card 106 is pressed against the bottom wall 112 of the base 102. In general, the lid insert 130 and/or the base insert 108 further maintain the gift card 106 in a substantially static and/or fixed position such that the gift card 106 is generally inhibited from movement within the assembled lid 104 and base 102. As described above, with the gift card 106 pressed against the bottom wall 112 of the base 102, the window 128 of the base 102 permits visualization of indicia 146 located on the gift card 106. A user can therefore visualize and implement, for example, scan, input, and/or the like, the information provided by the indicia 146 without removing the gift card 106 from the assembly 100. For example, a bar code on the gift card 106 can be scanned at a point of sale without having to open the assembly 100. In addition, the user can implement the indicia 146 on the gift card 106 for provisioning and/or activating the gift card 106 without having to open the assembly 100.

While exemplary embodiments have been described herein, it is expressly noted that these embodiments should not be construed as limiting, but rather that additions and modifications to what is expressly described herein also are included within the scope of the invention. Moreover, it is to be understood that the features of the various embodiments described herein are not mutually exclusive and can exist in various combinations and permutations, even if such combinations or permutations are not made express herein, without departing from the spirit and scope of the invention.

The invention claimed is:

1. A gift card box, comprising:

a base having a plurality of base walls defining a base inner periphery;

a first insert within said base inner periphery, the first insert defining a first insert inner periphery defining a ledge configured and dimensioned to receive therein a gift card, the first insert defining a first alignment member;

a lid configured to form a friction fit with said base and having a plurality of lid walls defining a lid inner periphery; and a second insert within said lid inner periphery, the second insert configured and dimensioned to cooperatively mate with the first insert, the second insert defining a second alignment member complementary to the first alignment member;

wherein the first and second alignment members maintain the lid in an orientation relative to the base by (1) cooperatively mating when properly aligned, and (2) substantially preventing the lid from lowering onto the base when improperly aligned, and wherein the first insert and the second insert substantially fix the gift card inside the gift card box when cooperatively mated;

and wherein the base has a window configured and dimensioned to permit visualization of indicia on the gift card when the gift card is fixed inside the gift card box.

2. The gift card box of claim 1, wherein the first insert and the second insert are fabricated from a foam material.

3. The gift card box of claim 1, wherein the indicia is at least one of a bar code, a price indicator, and instructions.

4. The gift card box of claim 1, wherein the lid and the base are configured and dimensioned to cooperatively mate.

5. The gift card box of claim 4, wherein cooperatively mating the lid and the base cooperatively mates the first insert and the second insert.

6. The gift card box of claim 4, comprising at least one decoration including an inner passage configured and dimensioned to slidably receive a cooperatively mated lid and base.

7. The gift card box of claim 6, wherein the at least one decoration is a bow.

8. A method of assembling a gift card box, comprising:

providing a base having a window configured and dimensioned to permit visualization of indicia on a gift card and having a plurality of base walls defining a base inner periphery:

inserting a first insert within said base inner periphery, the first insert defining a first insert inner periphery defining a ledge configured and dimensioned to receive therein the gift card, the first insert defining a first alignment member;

providing a lid configured to form a friction fit with said base and having a plurality of lid walls defining a lid inner periphery:

inserting a second insert within said lid inner periphery, the second insert configured and dimensioned to cooperatively mate with the first insert, the second insert defining a second alignment member complementary to the first alignment member;

attempting to align the first and second alignment members to maintain the lid in an orientation relative to the base, the alignment members (1) cooperatively mating when properly aligned, and (2) substantially preventing the lid from lowering onto the base when improperly aligned; and substantially fixing the gift card inside the gift card box by cooperatively mating the first insert and the second insert so as to permit visualization of indicia on the gift card through the window.

9. The method of claim 8, comprising inserting the gift card within the first insert of the base.

10. The method of claim 8, comprising cooperatively mating the lid and the base to cooperatively mate the first insert and the second insert.

11. The method of claim 8, comprising aligning complementary features defined by the first insert and the second insert.

12. The method of claim 10, comprising slidably receiving a cooperatively mated lid and base within an inner passage of at least one decoration.

* * * * *